US005584413A

United States Patent [19]

Jung

[11] Patent Number: 5,584,413

[45] Date of Patent: Dec. 17, 1996

[54] PLEATED PLASTIC CONTAINER

[76] Inventor: Myung G. Jung, 111-103, Doosan Apt. Keumho-3ga, Sungdogn-gu, Seoul, Rep. of Korea, 133-093

[21] Appl. No.: 489,290

[22] Filed: Jun. 9, 1995

[30] Foreign Application Priority Data

Jun. 9, 1994 [KR] Rep. of Korea ..... 94-13354

[51] Int. Cl.[6] ..... B65D 81/32

[52] U.S. Cl. ..... 220/666; 215/382

[58] Field of Search ..... 220/666; 215/11.3, 215/382

[56] References Cited

U.S. PATENT DOCUMENTS

| | | | |
|---|---|---|---|
| 2,886,084 | 5/1959 | Davison | 220/666 |
| 2,899,110 | 8/1959 | Parker | 215/382 X |
| 3,143,429 | 8/1964 | Swanson et al. | 215/11.3 X |
| 5,002,193 | 3/1991 | Touzani | 215/382 X |
| 5,310,068 | 5/1994 | Saghri | 220/666 X |
| 5,348,173 | 9/1994 | Norwood | 220/666 X |
| 5,384,138 | 1/1995 | Robbins, III et al. | 220/666 X |

FOREIGN PATENT DOCUMENTS

| | | |
|---|---|---|
| 44-4947 | 4/1969 | Japan . |
| 54-64641 | 5/1979 | Japan . |

*Primary Examiner*—Steven M. Pollard

*Attorney, Agent, or Firm*—Jacobson, Price, Holman & Stern, PLLC

[57] ABSTRACT

A pleated plastic container which is foldable and stored in a minimum space. The container comprises a foldable container body having a bottom protrusion, a mouth for being closed by a plug and for being fittingly engaged with said bottom protrusion, an outwardly directed concave recess formed at a neck portion of said mouth, and a lateral protrusion formed on the periphery of said bottom protrusion for fittingly engaging with said concave recess.

6 Claims, 1 Drawing Sheet

PLEATED PLASTIC CONTAINER

BACKGROUND OF THE INVENTION

This invention relates to a pleated plastic container which can be folded and stored in a minimum space.

A conventional pleated plastic container has a property of being unfolded or opened due to the resiliecy of each pleat, unless the inner space of the container maintains vaccum. Therefore, when not in use, the pleated container is pushed in the pleated direction for decreasing volume. Thereafter, a mouth of the container is closed by a plug for preventing the incoming of the outside air.

However, because the container itself is made of a plastic material which is expanded and contracted depending on the change of the atmospheric temperature, a perfect sealing between the mouth portion and the plug can not be expected.

As time passes, a folded pleated container is opened or unfolded. This phenomenon shows that the vacuum of the inner space of the container is not perfectly maintained.

It is not desirable that some portion or whole body of the folded container is unfolded.

For example, it is desirable that disposable water containers or various beverage containers should occupy a minimum space when folded and discarded. The minimum volume of such containers should be maintained when used containers are collected, transported and regenerated for cost saving and work convenience. Accordingly, the pleated containers should have minimum volume even after they are discarded.

For preventing the opening or unfolding of folded containers, strings are used to tie the containers or heavy things such as bricks often are placed on the containers. It is cumbersome and ugly to tie the containers with strings or to place bricks on the containers.

For overcoming such disadvantages, Japanese Utility Model Publication No. 44-4947 and Utility Model Open Publication No. 54-64641 disclose a pleated container having a protrusion on the inner periphery of a mouth portion. When folding the pleated container, the protrusion is folded and locked against the bottom of the container body. The prior container tends to be unfolded due to a large restoring force of the material thereof.

SUMMARY OF THE INVENTION

An object of the present invention is to provide a pleated plastic container having a locking means by which locking of the container in folded or compressed state is certainly achieved.

Another object of the present invention is to provide a pleated plastic container which is folded and stored in a minimum space.

The pleated plastic container according to the present invention comprises a foldable container body having a bottom protrusion, a mouth for being closed by a plug and for being fittingly engaged with said bottom protrusion, an outwardly direction concave recess formed at a neck portion of said mouth and a lateral protrusion formed on the periphery of said bottom protrusion for fittingly engaging with said concave recess, the outer diameter of the protrusion being the same as the inner diameter of the mouth.

BRIEF DESCRIPTION OF THE DRAWINGS

Other objects of the present invention will become apparent from the following description in conjunction with the drawings, in which.

DETAILED DESCRIPTION OF THE INVENTION

Figure 1:
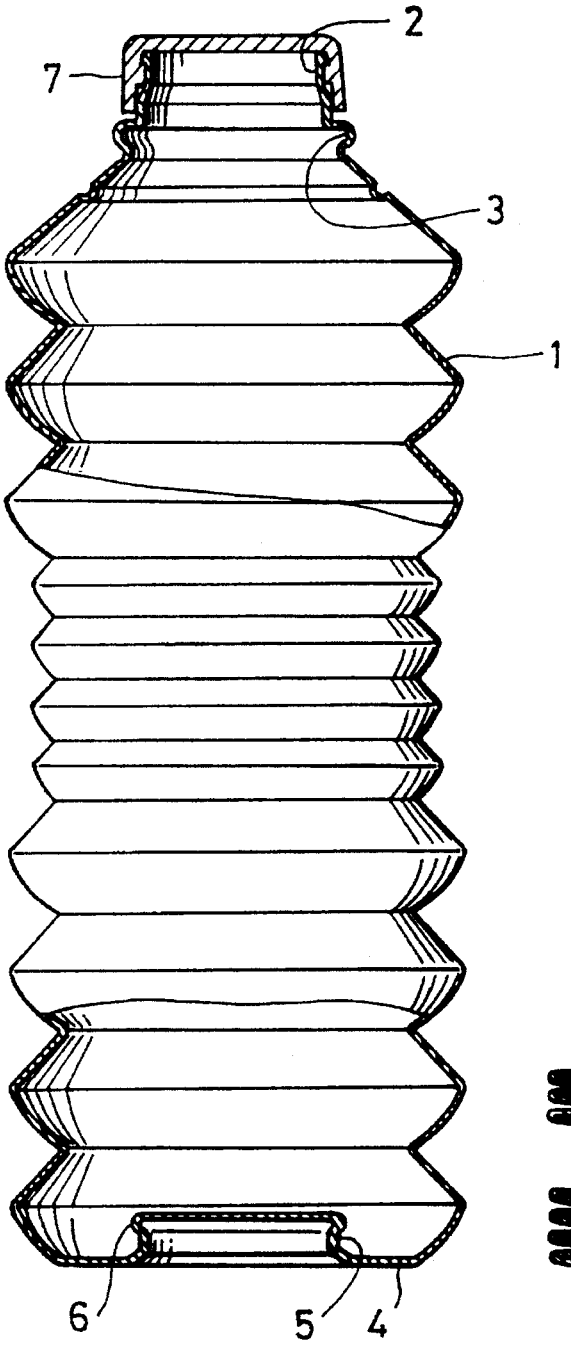
FIG. 1 is a partly out-away front view of the pleated plastic container of the present invention.

FIG. 1 is a front view of the pleated plastic container of the present invention, showing partly out-away mouth, bottom and a portion of the periphery thereof. As shown, the pleated plastic container of the present invention comprises a body 1 and a mouth 2 or central aperture provided in the top of the container. Between the upper periphery of the body 1 and the lower periphery of the mouth is provided an outwardly directing concave recess 3. A bottom protrusion or upwardly extending portion 5 extends from the center of a bottom 4, the outer diameter of the protrusion 5 being the same as the inner diameter of the mouth 2. A lateral protrusion 6 extends from the upper periphery of the bottom protrusion 5.

The concave recess 6 is the same as the lateral protrusion 6 in numbers and direction. With is arrangement, as the pleated plastic container is folded completely, the concave recess 3 gets nearer to and engages the lateral protrusion 6. The height of the bottom protrusion 5 may be the same as or slightly larger than the height of the body 1 when the body 1 is folded completely. With this arrangement, the concave recess 6 can engage the concave recess 3.

Figure 2:
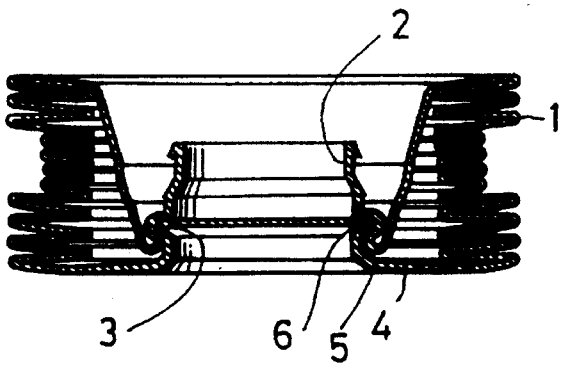
FIG. 2 is a longitudinal sectional view of the pleated plastic container of the present invention in folded, closed condition.

FIG. 2 is a longitudinal sectional view of the pleated plastic container of the present invention in completely folded, closed condition. As shown, when the body 1 is completely folded, the mouth 2 covers the bottom protrusion and the concave recess 3 engages and covers the lateral protrusion 6. With this arrangement, the folded body 1 is locked.

The locking state of the concave recess 3 and the lateral protrusion 6 can not be loosened by the expansibility of the pleats unless the container is forcedly pulled.

The minimum volume of the pleated container can be maintained with the above-described arrangements. Thereafter, a plug 7 is not needed for the maintenance of the pleated container.

When it is desired to put a beverage or food in the container 1, the folded container 1 is held by one hand and the mouth 2 is gripped and pulled by the other hand for loosening the locking state of the container 1. Then, beverage of food is put in the container 1.

In brief, the pleated plastic container of the present invention is folded completely and stored in a minimum space safely by using the bottom protrusion 5 and the concave recess 3 of the mouth 2. Once the plated plastic container is locked, the locked condition is maintained unless being manually opened. Thus, the pleated plastic container of the present invention is convenient to be stored. When the container is discarded, it occupies minimum space, rendering the disposal thereof convenient. Furthermore, lots of the containers can be loaded on a vehicle, thus saving transportation cost, bringing the convenience of transportation and providing regenerating factories with convenience.

By using the pleated plastic container of the present invention, it is not necessary to separately tie containers or press containers with heavy things.

In particular, the pleated plastic containers of the present invention is effectively used as disposable water containers, various commercial drinking containers, condiments containers and medical supplies containers.

The matter set forth in the foregoing descriptions and accompanying drawings is offered by way of illustration only and not as a limitation. The actual scope of the invention is intended to be defined in the following claims when viewed in their proper perspective based on the prior art.

What is claimed is:

1. A container comprising:

a pleated container body having an internal cavity, defined by a container wall, said body having a top and a bottom and being compressible in at least a longitudinal direction;

an internalized locking arrangement for locking said container body in a compressed condition comprising said bottom having an upwardly extending portion provided with a lateral abutment and said top having a lateral recess commensurate in shape with said lateral abutment for engagement with said lateral abutment, within said internal cavity of said container body.

2. The container of claim 1 wherein said top comprises a neck portion and a central aperture which is closeable with a plug.

3. The container of claim 1 wherein said pleated body of the container comprises at least two pleated regions, one of said at least two pleated regions having a diameter which is smaller than the other of said at least two pleated regions.

4. The container of claim 1 wherein said container is made from plastic.

5. The container of claim 1 wherein said container wall is integral with and forms said upwardly extending portion.

6. The container of claim 5 wherein said container wall is integral with and forms said lateral recess.

* * * * *